US005404815A

United States Patent [19]

Reed

[11] Patent Number: 5,404,815

[45] Date of Patent: Apr. 11, 1995

[54] BULLET AND PROCESS FOR MAKING SAME

[75] Inventor: Lee A. Reed, Quinter, Kans.

[73] Assignee: Swift Bullet Company, Quinter, Kans.

[21] Appl. No.: 110,084

[22] Filed: Aug. 20, 1993

[51] Int. Cl.[6] ..... F42B 12/34

[52] U.S. Cl. ..... 102/507; 102/516; 102/517; 29/1.23

[58] Field of Search ..... 102/507–510, 102/514–517, 518; 29/1.23, 1.2, 1.21, 1.22

[56] References Cited

U.S. PATENT DOCUMENTS

| | | | |
|---|---|---|---|
| 1,328,334 | 1/1920 | Newton | 102/507 |
| 2,792,618 | 5/1957 | Walker | 29/1.23 |
| 2,958,287 | 11/1960 | Auxier | 29/1.23 |
| 3,069,748 | 12/1962 | Nosler | 29/1.23 |
| 3,173,371 | 3/1965 | Manshel | 102/508 |
| 4,750,427 | 6/1988 | Carter | 102/516 |

FOREIGN PATENT DOCUMENTS

| | | | |
|---|---|---|---|
| 869595 | 2/1942 | France | 102/507 |
| 6588 | of 1897 | United Kingdom | 102/516 |

*Primary Examiner*—Harold J. Tudor
*Attorney, Agent, or Firm*—Don M. Bradley; Shook, Hardy & Bacon

[57] ABSTRACT

An improved process for fabricating an improved bullet is provided, with the bullet having a jacket characterized by enhanced structural integrity. As a result of the swaging process utilized to form the bullet jacket, the jacket has less likelihood of incurring internal stress during the manufacturing process than can be associated with conventionally fabricated bullet jackets. The uniformity of the base portion of the improved bullet is increased, thereby enhancing the accuracy and effectiveness of the improved bullet.

15 Claims, 2 Drawing Sheets

Fig. 1.
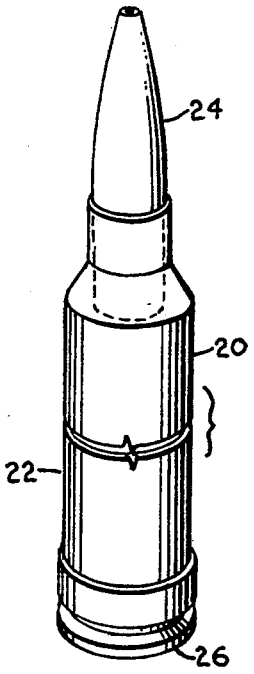
PRIOR ART
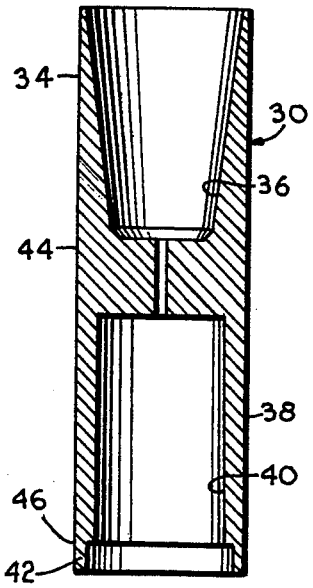
Fig. 2.
Fig. 4.
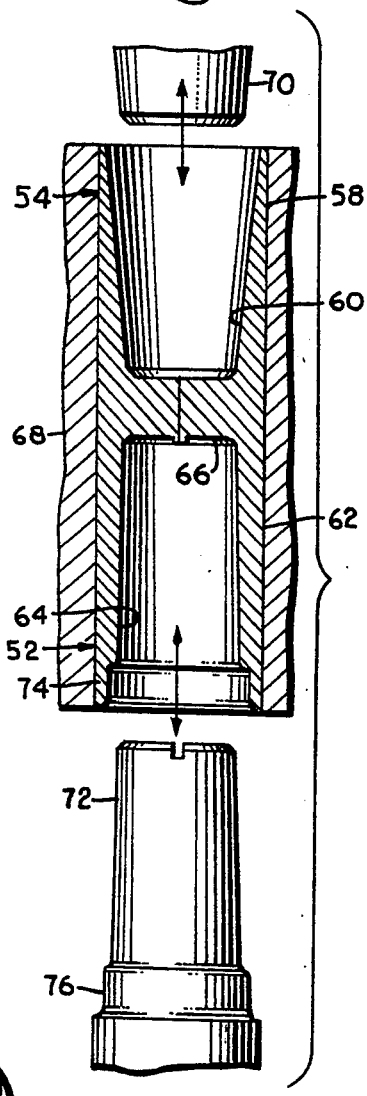
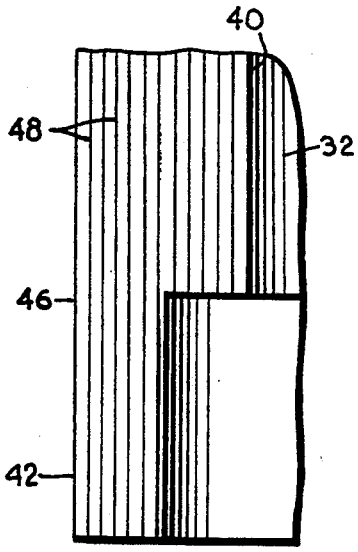
PRIOR ART
Fig. 3.
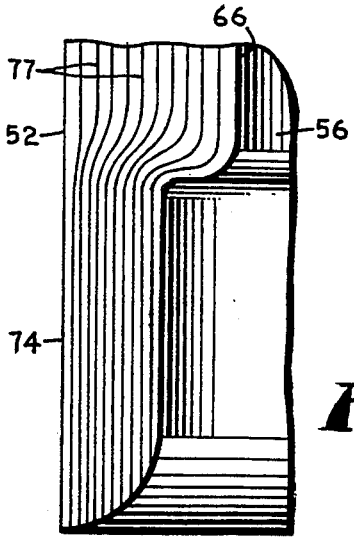
Fig. 5.

PRIOR ART

BULLET AND PROCESS FOR MAKING SAME

BACKGROUND OF THE INVENTION

This invention relates in general to a process for manufacturing bullets and, more particularly, to a method for manufacturing bullets having improved accuracy and increased weight.

There are a wide variety of projectiles or bullets for use with firearms, with the various bullets having specific characteristics designed according to the purpose, or type of target, at which the bullet is to be fired. The outer shape of the bullet is designed in order to achieve a favorable ballistic trajectory. Conventional bullets are tapered from a point at the nose of the bullet to the cylindrical portion of the bullet, the tapering being referred to as the ogive. The bullet is typically housed within a cartridge, which also contains the propellant charge. At the base of the cartridge is the primer, which contains the primary explosive. When the primer is ignited, the resultant explosion detonates the propellant charge.

The bullet is positioned within a gun barrel, the purpose of which is to allow the bullet to quickly reach an acceptably high initial velocity using energy released when the propellant charge is detonated, and additionally to aim the bullet toward the target. The bullet is loaded into the barrel, with a driving band at the back end of the bullet being gripped by the rifling within the barrel. As the gun is fired, the primer is struck and thereby ignited by the firing pin, which in turn detonates the propellant charge. As the explosive powder burns, high gas pressure is built up in the chamber of the gun. When this gas pressure exceeds the pressure retaining the driving band in the rifling, the bullet is set in motion. At the exact moment the bullet leaves the barrel, the gas pressure exerted on the base of the bullet should be as uniform as possible to assure an accurate trajectory toward the intended target.

During the manufacturing process generally employed for conventional bullets, the bullet jackets, typically fabricated from copper tubing or nuggets, are filled with a weighted material, such as lead or a leaden component, by a variety of conventional methods. The lead within custom made bullets is often heat bonded to the copper jacket, while in the mass produced bullets, the lead typically is not heat bonded. Heat bonding is generally preferred as it enhances the weight retention of the bullet upon striking and penetrating the target, thereby increasing the penetration of the bullet.

When heat bonding methods are used, it can be difficult to properly form the base of the bullet. The base is generally formed by rolling the bottom edge of the bullet jacket inwardly to securely retain the lead within a cavity thereof. If too much pressure is applied to the base during the rolling process, the lead may be forced out of the bullet nose, thereby ruining the bullet. Thus, rolling the bottom edge of the jacket to form a base is a difficult process which has not always produced satisfactory results. As the amount of pressure which can be used in the rolling process is limited, the base of the conventionally produced bullet typically has a rounded edge which is not always uniform. In order to assure uniformity of the base, greater pressure is often needed, although it cannot always be effectively accommodated in heat bonded bullets. As discussed above, uniformity of the base is critical for accuracy, as the base is the last portion of the bullet to exit the firearm barrel. If gas is allowed to escape from one side of the barrel around one portion of the bullet base before it escapes from another side of the barrel, accuracy of the bullet trajectory will be compromised.

In order to achieve a more uniform base, it has been known in the past to reduce the pressure required to bend or roll the bottom portion of the jacket by reducing the width of this bottom portion using a milling tool to create an internal indentation therein. However, this milled indentation has not created a satisfactory product, as the rim portion having the reduced width is often weaker than a conventional rim, and the conventional bending process tends to create stress or even stress cracks around the outer lower circumference of the conventional bullet. In addition, the method by which the indentation is milled in the rim portion decreases the potential weight of the bullet, an undesired result in bullet manufacture.

SUMMARY OF THE INVENTION

It is therefore an object of the present invention to provide a process for manufacturing an improved bullet having a jacket characterized by enhanced structural integrity.

It is another object of the present invention to provide a manufacturing process which creates an improved bullet by relieving stress that would otherwise remain in a bullet jacket fabricated by conventional processes.

It is a further object of this invention to provide a method for manufacturing an improved bullet having a base comprising an essentially uniform lower outer circumference so that enhanced accuracy of the bullet trajectory is achieved.

It is still another object of the present invention to provide a method for manufacturing improved bullets having increased total weight so that the bullet of the present invention, when fired from a firearm, is able to achieve greater penetration of the target.

To accomplish these and other related objects of the invention, in one aspect the invention is related to a process for manufacturing a bullet having an essentially tubular jacket therearound, wherein the process includes creating a region of reduced wall thickness adjacent a trailing end of the jacket by using a swaging process, and bending the area of reduced thickness inwardly to provide a rim extending radially inwardly from the jacket. In another aspect, the process of the invention forms a bullet having a jacket characterized by a pair of cavity regions separated by a solid integral annular member in the nature of a partition intermediate and spaced from a leading end of the jacket and a trailing end of the jacket, wherein the partition is also formed by the swaging process.

BRIEF DESCRIPTION OF THE DRAWINGS

In the accompanying drawings which form a part of the specification and are to be read in conjunction therewith and in which like reference numerals are used to indicate like parts in the various views:

FIG. 1 is a side perspective view of a cartridge housing the bullet of the present invention;

FIG. 2 is a side elevational view taken in vertical section of a conventional bullet jacket;

FIG. 3 is an enlarged fragmentary view of a portion of the bullet jacket of FIG. 2, showing an illustrative representation of the density of the lip of the jacket base;

FIG. 4 is a side elevational view taken in vertical section of a bullet jacket made in accordance with the present invention, showing a schematic fragmentary view of one set of the dies and associated punches used to form the bullet jacket;

FIG. 5 is an enlarged view of a portion of the bullet jacket of FIG. 4, showing an illustrative representation of the density of the lip of the jacket base;

DESCRIPTION OF THE PREFERRED EMBODIMENTS

Figure 6:
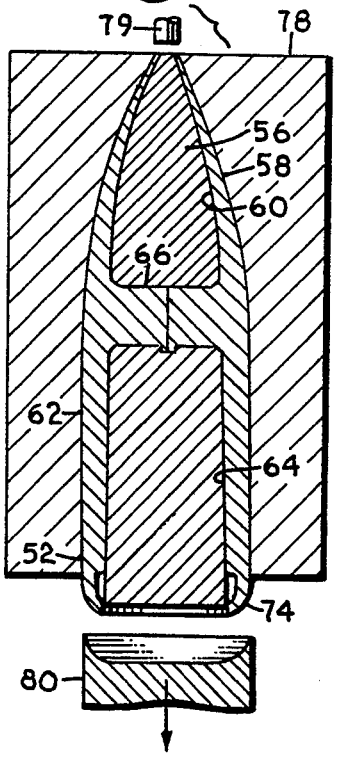
FIG. 6 is a side elevational view taken in vertical section of the bullet jacket of FIG. 4, showing in a schematic fragmentary view another of the dies and associated punches in accordance with the present invention.

Turning now to the drawings in greater detail, and initially to FIG. 1, a cartridge in accordance with the present invention is represented by the numeral 20. Cartridge 20 comprises a casing 22 which receives a bullet 24 manufactured in accordance with the present invention at one end and a primer 26 at the other end. There are a variety of differing sizes of casing 22 in order to accommodate bullets 24 of various calibers and weights.

Bullet 24 is constructed in a manner to increase the uniformity of its base and reduce the likelihood of stress cracks and other deformities frequently found in conventional bullets which can reduce the accuracy of the bullet trajectory. The construction of bullet 24 in comparison to conventional bullets can best be seen with reference to FIGS. 2–10. Turning first to FIG. 2, a jacket of conventional manufacture is represented by the numeral 30. Jacket 30 is typically fabricated from copper and is used to encase the weighted material such as leaden component 32 of the finished bullet (FIG. 10). Jacket 30 includes an essentially circular leading end 34 which end leads the bullet 24 with respect to the trajectory thereof during use. Leading end 34 presents a leading cavity 36 for receiving a leaden component 32 therein to be encased within leading end 34. Jacket 30 further includes an essentially circular trailing end 38 which trails the leading end 34 with respect to the trajectory of the bullet 24 during use. Trailing end 38 presents a trailing cavity 40 for receiving a weighted material such as a leaden component 32 therein to be encased within trailing end 38. An integral annular member in the nature of a partition 44 substantially spans the distance between the inner walls of the bullet jacket 30, dividing the jacket into a pair of separate cavities, leading cavity 36 and trailing cavity 40, and additionally separating the leaden components 32 encased within the cavities 36, 40.

The bottom portion 46 of trailing end 38 comprises an internal indentation or lip 42 formed by milling a segment from the inner wall of the bottom portion 46 of trailing end 38. This indentation is most clearly seen in FIG. 3, wherein the density of the wall of bottom portion 46 of conventional bullet jacket 30 is illustrated symbolically by the vertical lines 48 depicted. It can be appreciated that the formation of lip 42 does not cause any noticeable compression of wall material, and thus the density of lip 42 and bottom portion 46 are substantially identical due to the use of a milling tool to form lip 42 rather than swaging of the jacket 30.

Turning to FIG. 10, the bending of the sharp, substantially right angles of milled lip 42 during the manufacturing steps that produce the finished bullet can create concentrated areas of stress which may lead to the formation of stress cracks 49 along the sharp corner of the lower outer circumference of the base 28. These stress cracks 49 (and other deformities) are generally undesirable in that they can distort the uniform distribution of impact force received during the bullet firing process, which in turn can compromise the accuracy the bullet trajectory. Additionally, the strength of base 28 is critical with respect to the integrity of the bullet upon impact, as a weakened base may result in the leaden component separating from the copper jacket 30 when the bullet impacts the target.

By contrast, the bullet 24 of the present invention is constructed in a manner to increase the uniformity of the base 75, thereby reducing the incidence of stress cracking and other deformities which results in increased accuracy of the bullet flight trajectory, and which further results in providing greatly desired additional weight to the bullet to aid in its efficiency upon impact. The fabrication process for bullet 24 can best be seen with reference initially to FIG. 4, wherein a jacket is represented by the numeral 54. As with the conventional jacket 30, jacket 54 is typically fabricated from copper and is used to encase a weighted material such as leaden component 56 of the finished bullet (FIGS. 6–9). Jacket 54 includes an essentially circular leading end 58 which leads the bullet 24 with respect to the trajectory thereof during the firing of the bullet 24. Leading end 58 presents a leading cavity 60 for receiving a leaden component 56 therein to be encased within leading end 58. Jacket 54 further includes an essentially circular trailing end 62 which trails the leading end 58 with respect to the trajectory of the bullet 24 during use. Trailing end 62 presents a trailing cavity 64 for receiving a leaden component 56 therein to be encased within trailing end 62. An essentially solid integral annular member in the nature of a partition 66 completely spans the distance between the inner walls of bullet jacket 54 at a position intermediate and spaced from leading end 58 and trailing end 62, dividing the jacket 54 into a pair of separate cavities, leading cavity 60 and trailing cavity 64, and additionally separating the associated leaden components 56 encased therein.

The leading end 58, trailing end 62 and partition 66 are formed by a swaging process using a die 68 and upper and lower punches, 70 and 72, respectively. Jacket 54 is initially comprised of copper tubing, and partition 66 is formed as excess copper is swaged from the inner walls of jacket 54 and forced inwardly by punches 70, 72 as they shape the inner walls of leading and trailing ends 58, 62. It is understood that a solid copper cylinder could alternatively be utilized to form the bullet jacket of the present invention in place of copper tubing. The bottom 18 portion 52 of trailing end 62 comprises an indentation or shouldered lip 74, which is also formed during the same swaging process, and which is most clearly seen in FIG. 5. The shoulder portion of lip 74 presents a rounded surface and is positioned on the interior of jacket 54 adjacent the upper portion of lip 74. The rearward end of lip 74 presents an arced surface on the interior of jacket 54. As is apparent, the specific configuration of lip 74 with its reduced wall thickness is formed by the swaging process as portion 76 of lower punch 72 is forced against the inner wall material of jacket 54. As illustrated by the symbolic vertical lines 77 of FIG. 5, the wall material of jacket 54 is shown to have moved upwardly as a result of the swaging process during the formation of lip 74, and due to the configuration of portion 76 of punch 72, the wall material of lip 74 is compacted to a further extent as compared to the compacting of the wall material of the remaining portions of jacket 54. As is apparent, the swaging process creates internal compressive stresses at the upper portion of lip 74, which stresses are somewhat relieved by the bending of the lip 74 to form base 75. Thus, a corner having a radius is formed from swaged lip 74 instead of the conventional sharp corner, the base 75 thereby having enhanced structural integrity due to the partially relieved stresses of lip 74.

By comparison, as lip 42 of conventional jacket 30 is formed by milling the wall material, the material at lip 42 is the same density as the remainder of the jacket 30 and is thus under no unusual stress. The rolling or bending of lip 42 is, therefore, more likely than is the bending of lip 74 in accordance with the present invention to create stress in the corner formed during the bending of the bullet base. For this reason, there is an increased likelihood that fractures will be propagated from the stress created during the bending process of conventional lip 42 wherein the sharp corner of base 28 is formed.

Figure 9:
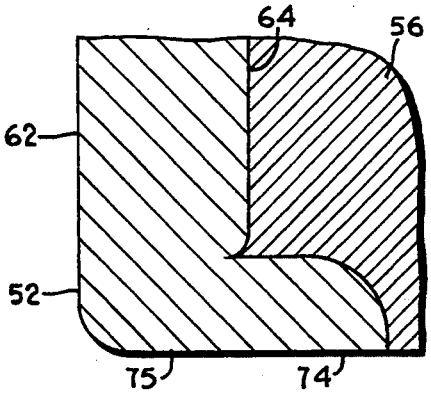
FIG. 9 is an enlarged fragmentary view of the base of the bullet of FIG. 8.
Figure 10:
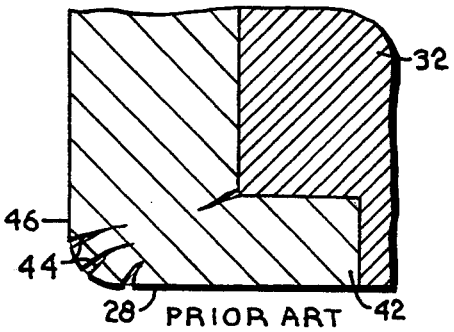
FIG. 10 is an enlarged fragmentary view of the base of a bullet manufactured in accordance with conventional processes.

By means of further comparison, FIG. 9 depicts the rolled or bent lip 74 which forms base 75 during the manufacturing process of the finished bullet 24. The greater density and the above-described subsequent stress release during the creation of lip 74 leads to a more stress-free, even bend and therefore a more uniform lower outer circumference of the base 75, and in this manner tends to enhance the accuracy of the bullet 24 during use. In addition, the increased density of lip 74 manufactured in accordance with the swaging process of the present invention adds desired weight to bullet 24 not found with conventional bullets, as no material is lost or removed during the formation of lip 74, whereby the retained weight enhances penetration of the target pierced by the bullet 24.

Figure 7:
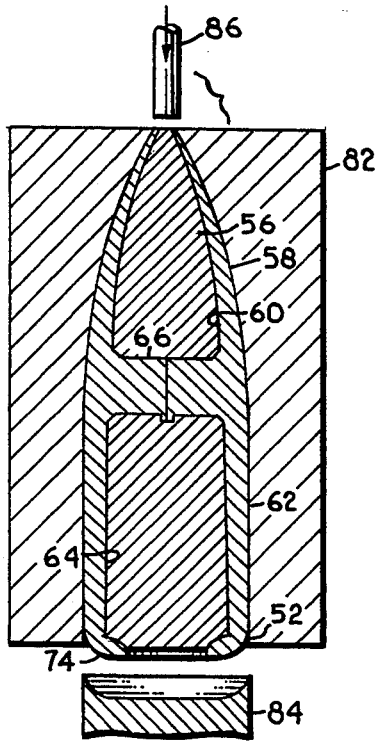
FIG. 7 is a view as in FIG. 6, showing another of the dies and associated punches.
Figure 8:
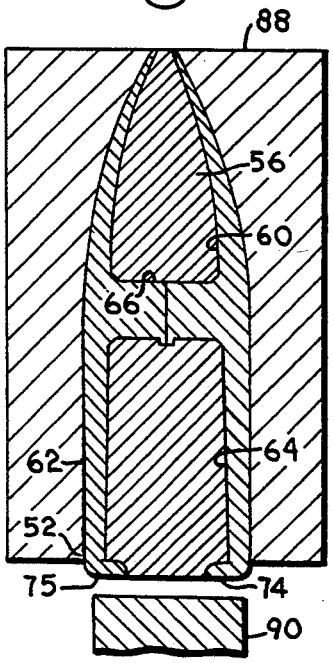
FIG. 8 is a view as in FIGS. 6 and 7, showing still another of the dies and associated punches.

Turning next to FIGS. 6-8, the manufacturing process in accordance with the present invention is most clearly shown. After leading end 58, trailing end 62, and partition 66 have been formed by the swaging process as illustrated in FIG. 4, leaden component 56 in a solid state, such as a slug, is placed in leading cavity 60 and is thereafter heated by conventional means in leading cavity 60 to a temperature sufficient to at least partially melt leaden component 56 in the region of contact with the jacket 54. Upon cooling of the leaden component 56 and leading end 58, the melted material bonds to jacket 54. Next, another leaden component 56 is placed into trailing cavity 64, but is not bonded thereto. Jacket 54 with its associated leaden components 56 is then placed into die 78. Punch 80 is caused to strike lip 74 of jacket 54 to create a slight bending or rolling thereof so as to retain lead component 56 in trailing cavity 64. Die 78 also causes the upper portion of leading end 58 to bend inwardly to securely retain the heat bonded leaden component 56 therein. Pin 79 is typically used in a conventional manner to aid in the removal of bullet 24 from the die 68. Bullet 24 is next placed in die 82, where punch 84 completes the bending or rolling process of lip 74. Pin 86 assists in the removal of bullet 24 from die 82. Bullet 24 is then positioned in the final die 88, where punch 90 flattens the lip 74 and creates a base 75 having a smooth and even lower outer circumference. Base 75 secures the leaden component 56 within the trailing cavity 64. This configuration is best seen in FIG. 9, discussed above.

The present invention is especially useful for heat bonded bullets such as those manufactured by custom artisans, as heat bonded bullets 24 are produced by adding and subsequently heat bonding an initially solid leaden component 56 to leading cavity 60 first, and then cooling leaden component 56 and leading cavity 60 to bond the leaden component 56 thereto as discussed in more detail above. Next, leaden component 56 is added to trailing cavity 64. The bullet 24 is then placed in die 78, and pressure is applied to the lip 74 thereof to retain the leaden component 56 in trailing cavity 64 and form the base 75. It is critical to the integrity of the leading end 58 and associated leaden component 56 to limit the pressure applied by the punch 80 when forming base 75. In accordance with the present invention, one way to limit the pressure required to bend the lip 74 is to reduce the wall thickness thereof and thereby increase the ease with which lip 74 is bent. It is understood that the present invention is equally applicable to situations where a heat bonding process is not employed, although considerations such as limited pressure are not as critical when fabricating conventional non-heat bonded bullets, as the trailing cavity 64 of such conventional bullets can be filled with leaden component first, and the amount of pressure then used to form the base will not have any adverse effect on the leaden component of the leading cavity.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described the invention, what is claimed is:

1. A process for making a bullet comprising a tubular jacket having walls, a trailing end and a leading end, and containing a weighted material therein, said process comprising:

forming a compressively stressed region of reduced wall thickness to present an internal shouldered lip in the jacket at the trailing end of the bullet;

said forming step being carried out by advancing a swaging tool into the jacket to compress material comprising the jacket walls to create the compressively stressed region of reduced wall thickness proximal the shouldered lip;

inserting a weighted material into the jacket; and bending the jacket in the compressively stressed region of reduced thickness inwardly to form the shouldered lip into a rim extending radially inwardly from a jacket wall, the bending step at least partially relieving the compressive stress in the region imparted by the forming step.

2. The process as set forth in claim 1, said process further comprising forming two spaced cavity regions separated by a member in the nature of a partition intermediate and spaced from the leading and trailing ends of the jacket, said cavity forming step being carried out by advancing a swaging tool into the jacket to compress wall material to create the partition.

3. The process as set forth in claim 2, wherein the jacket after the cavity forming step comprises a leading cavity at the leading end of the jacket in advance of the partition, and a trailing cavity at the trailing end of the jacket on the other side of the partition.

4. The process as set forth in claim 3, wherein said inserting step further includes:

placing a weighted material in a solid state in the leading cavity;

bonding the weighted material to the portion of the jacket bounded by the leading cavity by a heating process; and placing a weighted material in a solid state in the trailing cavity without bonding thereto, wherein the bending of the jacket region of reduced thickness to provide the rim secures the weighted material in the trailing cavity.

5. The process as set forth in claim 4, said process further comprising bending the jacket in the region of the leading end forwardly radially inwardly to form a generally conical shape, said leading end bending step being carried out contemporaneously with the trailing end bending step.

6. An improved bullet prepared according to the process of claim 1.

7. The method of claim 1, further comprising configuring an innermost corner on the shoulder of the shouldered lip to present a rounded surface.

8. The method of claim 1, further comprising forming an arced surface on an interior of the jacket at a rearward end of the shouldered lip.

9. An improved bullet comprising a tubular jacket having walls, a leading end and a trailing end, and containing a weighted material therein, further comprising:

a compressively stressed region of reduced thickness in the jacket at the trailing end of the bullet presenting an internal shoulder; and a rim proximal the shoulder in said compressively stressed region of reduced thickness extending radially inwardly from a jacket tube wall and having less compressive stress in a bend zone than in the remaining portion of said compressively stressed region of reduced thickness.

10. The bullet as set forth in claim 9, further comprising two spaced cavity regions separated by a member in the nature of a partition intermediate and spaced from the leading and trailing ends of the jacket, the cavity regions being formed by a swaging process.

11. The bullet as set forth in claim 10, wherein the jacket comprises a leading cavity at the leading end of the jacket in advance of the partition and a trailing cavity at the trailing end of the jacket on the other side of the partition.

12. The bullet as set forth in claim 11, wherein the leading cavity contains a solid weighted material bonded thereto by a heat process.

13. The bullet as set forth in claim 12, wherein the trailing cavity contains a solid weighted material securely retained therein by the rim.

14. The bullet of claim 9, wherein an innermost corner on the shoulder presents a rounded surface.

15. The bullet of claim 9, wherein said compressively stressed region further presents an arced surface on an interior of the jacket at a rearward end thereof.

* * * * *